US008387679B2

(12) United States Patent
Inaba et al.

(10) Patent No.: US 8,387,679 B2
(45) Date of Patent: Mar. 5, 2013

(54) VACUUM DIE-CASTING MACHINE

(75) Inventors: Kyohei Inaba, Iwakura (JP); Kenji Yamazaki, Nishio (JP); Minoru Yamamoto, Nagoya (JP); Akihito Mizuno, Nagoya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 13/177,171

(22) Filed: Jul. 6, 2011

(65) Prior Publication Data

US 2012/0048498 A1 Mar. 1, 2012

(30) Foreign Application Priority Data

Aug. 24, 2010 (JP) ..... 2010-187246

(51) Int. Cl.
*B22D 27/00* (2006.01)

(52) U.S. Cl. ..... 164/267; 164/72; 164/312

(58) Field of Classification Search ..... 164/72, 164/267, 113, 120, 312–318
See application file for complete search history.

(56) References Cited

U.S. PATENT DOCUMENTS 5,842,509 A * 12/1998 Nagashima et al. ..... 164/63
5,842,510 A * 12/1998 Nagashima et al. ..... 164/72

FOREIGN PATENT DOCUMENTS

| | | |
|---|---|---|
| JP | A-02-151358 | 6/1990 |
| JP | A-09-052160 | 2/1997 |
| JP | A-09-277007 | 10/1997 |
| JP | A-09-277008 | 10/1997 |

OTHER PUBLICATIONS

Jul. 24, 2012 Office Action issued in Japanese Patent Application No. 2010-187246 (with translation).

* cited by examiner

*Primary Examiner* — Kuang Lin
(74) *Attorney, Agent, or Firm* — Oliff & Berridge, PLC

(57) ABSTRACT

A reduced size vacuum die-casting machine wherein an amount of powder release agent which is fed to a mold cavity each time is stable and loss of velocity of the air flow for sucking out the powder release agent is difficult, the apparatus provided with a powder control valve which has a powder release agent passage through which a powder release agent passes and which moves back and forth inside of a sleeve to switch between a state communicating a discharge hole with a molten metal holding chamber and a state communicating a discharge hole with a powder release agent passage, the powder release agent passage of the powder control valve formed inside of the powder control valve, the inlet and outlet of the powder release agent passage being formed at the outer surface of the powder control valve.

2 Claims, 3 Drawing Sheets

VACUUM DIE-CASTING MACHINE

BACKGROUND OF THE INVENTION

1. Field of the Invention

The present invention relates to a vacuum die-casting machine, more particularly relates to a vacuum die-casting machine which coats an inside of a mold cavity with a powder release agent, then evacuates the inside of the cavity and injects a molten metal (for example aluminum alloy).

2. Description of the Related Art

A conventional vacuum die-casting machine is described in Japanese Patent Publication (A) No. 9-277007 (see FIG. 3). This vacuum die-casting machine 900 clamps the die-casting dies, opens a shutoff valve 24 after clamping them, and, in that state, operates a not shown pressure reducing device (vacuum pump). Due to this, a mold cavity C is evacuated from an exhaust port 22 communicated with one side of the mold cavity C so as to reduce the pressure at the inside of the mold cavity C, while a powder release agent is fed from a melt passage 11 which is communicated with another side of the mold cavity to the inside of the mold cavity. The powder release agent is fed from a powder storage source T to a powder discharge passage 20, switch valve 19, switch flow path 13, and melt passage 11. When the powder release agent is fed into the cavity, the switch valve 19 switches the flow path whereby the powder discharge passage 20 and the switch flow path 13 are disconnected, the vacuum pump P and the switch flow path 13 are communicated, and air inside the cavity is sucked out and the inside of the cavity is held in a vacuum state. After that, the cylindrical valve 14 moves left whereby a molten metal holding chamber 8B inside the sleeve 8 and the cavity C are communicated. Further, the plunger 9 moves leftward to inject molten metal (aluminum alloy) which is filled in the molten metal holding chamber 8B to the cavity C and thereby fill the inside of the cavity C with the molten metal.

Further, inside a powder control valve guide hole G which is formed inside a sprue bushing 10 and a guide bushing 12, a powder control valve V is movably arranged. The powder control valve V is formed at its right end with a cylindrical valve part 14 which closely contacts the powder control valve guide hole G, is formed with a reduced size tube 15 from the cylindrical valve part 14 toward the left, is further formed with a guide tube 16 from the reduced size tube 15 toward the left, and is still further formed with an operating rod part 17 from the guide tube 16 toward the left. Between this reduced size tube 15 and guide hole G, there is a clearance volume 15A.

However, such a conventional vacuum die-casting machine suffers from the inconvenience that the powder release agent builds up in the clearance volume 15A which eventually causes the individual feed amounts of the power release agent into the mold cavity to become unstable. Furthermore, in the clearance volume 15A, the velocity of the air flow for sucking out the powder release agent is reduced. Furthermore, two vacuum pumps become necessary. The system becomes larger in size and the capital costs increase.

For more information on the related art, see the above-mentioned Japanese Patent Publication (A) No. 9-277007.

SUMMARY OF THE INVENTION

The present invention was made in consideration of the above problem and has as its object to provide a vacuum die-casting machine wherein the individual amounts of powder release agent which are fed into the mold cavity are stabilized and loss of velocity of the air flow for sucking out the powder release agent is difficult.

A vacuum die-casting machine of a first aspect of the present invention is provided with a movable die (4, 7) and a stationary die (1, 3), one or both of which having a cavity (C), a powder storage source (T) which stores a powder release agent which is to be coated on a surface of the cavity (C), a vacuum pump (P) which is communicated with the cavity (C) through a shutoff valve (24), a sleeve (8, 10, 12) which extends passing through the movable die (4, 7) and stationary die (1, 3) and which has a molten metal shot hole (8A) for the inflow of molten metal, a molten metal holding chamber (8B) which holds molten metal, and a discharge hole (10A) for discharging molten metal or powder release agent to the inside of the cavity (C), a molten metal injection plunger (9) which slides inside of the sleeve (8, 10, 12) to inject molten metal of the molten metal holding chamber (8B) from the discharge hole (10A) toward the cavity (C), and a powder control valve (30) which has a powder release agent passage (33) through which a powder release agent passes and which moves back and forth inside of the sleeve (8, 10, 12) to switch between a state which connects the discharge hole (10A) with the molten metal holding chamber (8B) and a state which connects the discharge hole (10A) with the powder release agent passage (33), the powder release agent passage (33) of the powder control valve (30) being formed inside of the powder control valve (30), and an inlet (33A) and outlet (33B) of the powder release agent passage (33) being formed at an outer surface of the powder control valve (30).

Due to such a structure, the vacuum die-casting machine of the present invention can be configured while using a single vacuum pump, so the vacuum die-casting machine can be made smaller in size. Further, the powder control valve (30) of the present invention does not have a structure like the reduced size tube of Japanese Patent Publication (A) No. 9-277007, so there is no clearance volume between the reduced size tube and the guide hole. For this reason, buildup of the powder release agent or loss of velocity of the air flow never occurs.

A vacuum die-casting machine of a second aspect of the present invention is characterized in that the powder control valve (30) can switch to a state which does not communicate the discharge hole (10A) with the molten metal holding chamber (88) and which does not communicate the discharge hole (10A) with the powder release agent passage (33) either. Due to this state, an evacuation step which shifts the cavity C to a vacuum state becomes possible.

A vacuum die-casting machine of a third aspect of the present invention is characterized in that the powder control valve (30) is provided with a cylindrical valve part (31) and an operating rod part (32), the inlet (33A) of the powder release agent passage (33) is formed at an outer surface of the operating rod part (32), and the outlet (33B) of the powder release agent passage (33) is formed at an outer circumferential surface of the cylindrical valve part (31). The specific structure of the powder control valve (30) is described.

BRIEF DESCRIPTION OF DRAWINGS

These and other objects and features of the present invention will become clearer from the following description of the preferred embodiments given with reference to the attached drawings, wherein.

DESCRIPTION OF THE PREFERRED EMBODIMENTS

Figure 1:
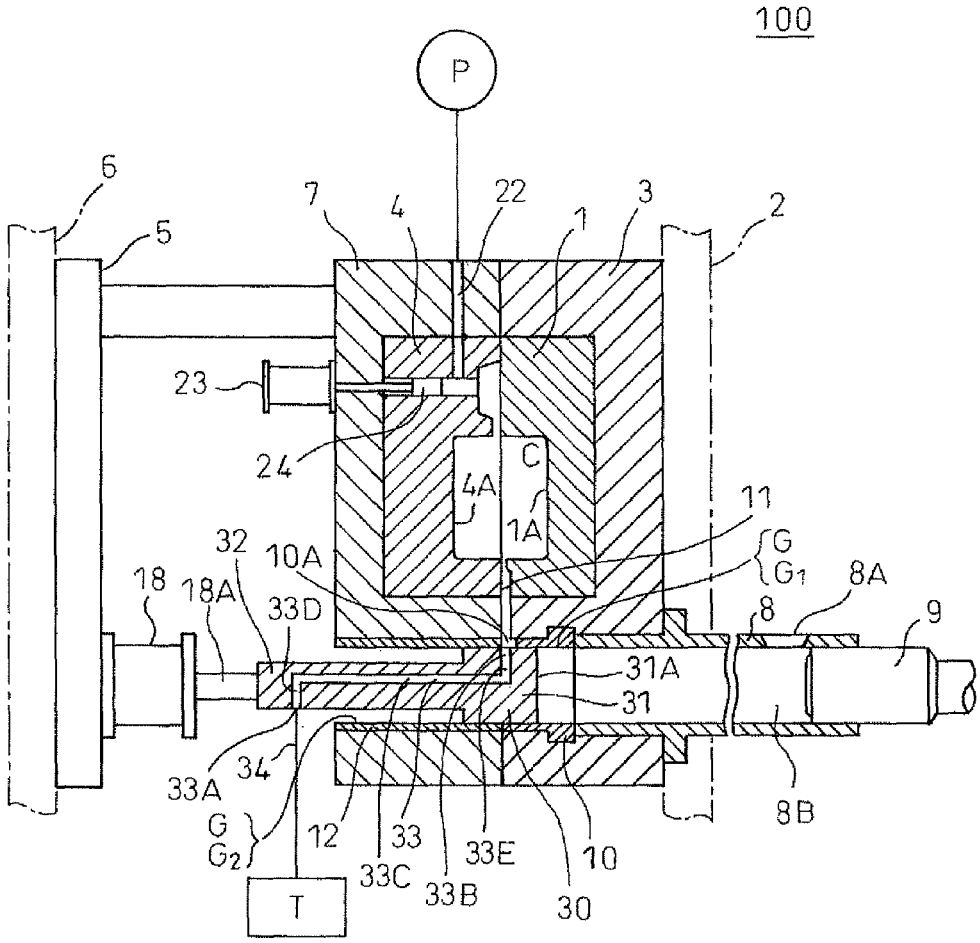
FIG. 1 is a cross-sectional view of the state of feeding a powder release agent to the inside of a cavity of a vacuum die-casting machine according to the present invention.
Figure 2:
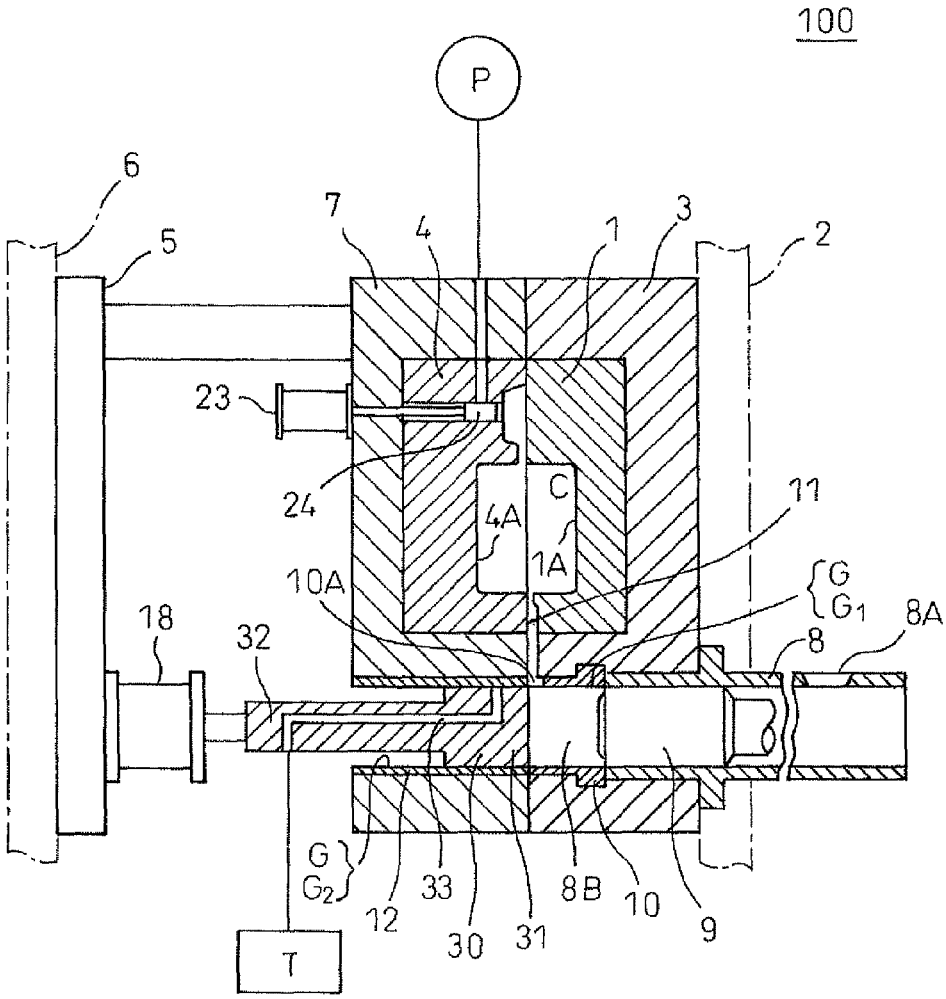
FIG. 2 is a cross-sectional view of a state of injecting molten metal into a cavity of a vacuum die-casting machine according to the present invention.
Figure 3:
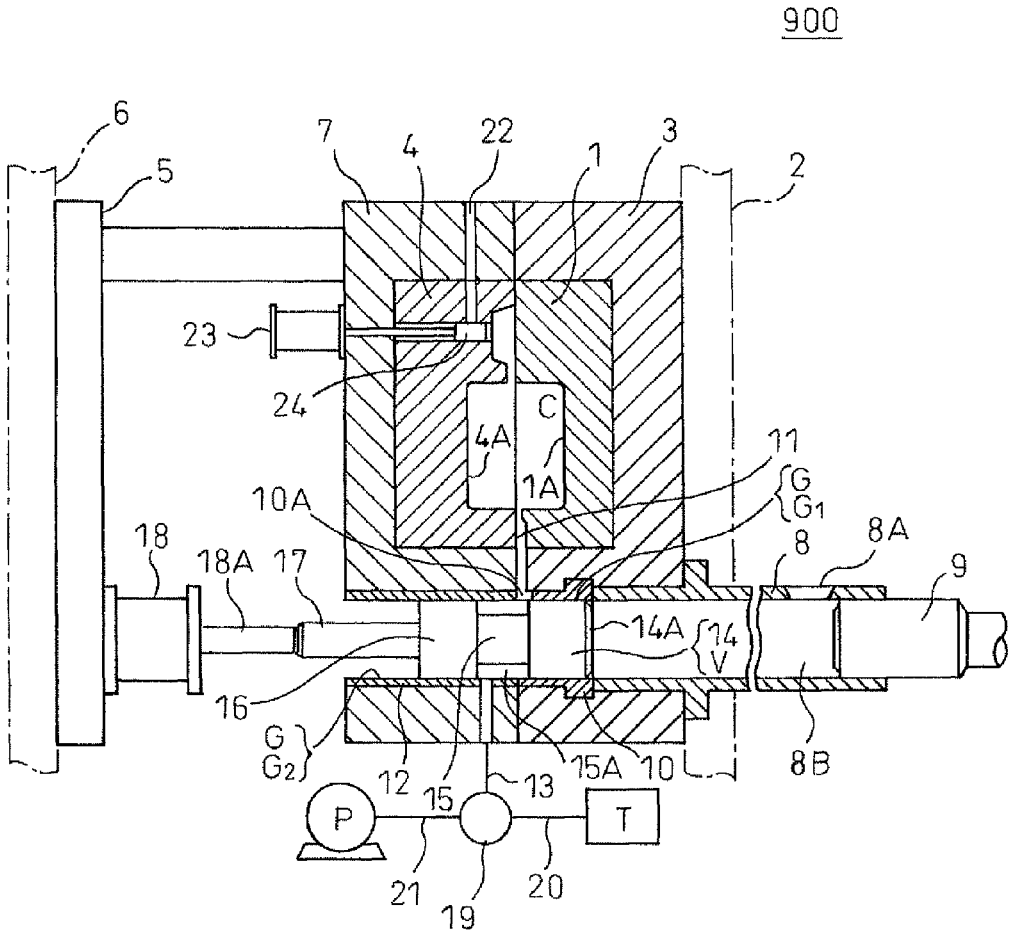
FIG. 3 is a cross-sectional view of a vacuum die-casting machine of the related art.

Below, an embodiment of the present invention will be explained based on the drawings. FIG. 1 and FIG. 2 show a vacuum die-casting machine 100 of the present invention. Reference numeral 1 indicates a fixed core in which a mold surface 1A corresponding to one product surface is provided recessed. This fixed core 1 is arranged fastened inside a stationary die fastened to a stationary platen 2 of the casting machine. Reference numeral 4 indicates a movable core in which a mold surface 4A corresponding to the other product surface is provided recessed. This movable core 4 is arranged fastened inside a movable die 7 which is fastened to a movable platen 6 through a die base 5.

By the facing surfaces of this fixed core 1 and movable core 4 abutting, the mold surface 1A of the fixed core 1 and the mold surface 4A of the movable core 4 form a cavity C corresponding to the product shape. Reference numeral 8 is a sleeve which passes through the stationary platen 2 and is fastened to the stationary die 3. Inside of the sleeve 8, a plunger 9 is movably arranged. Near the right end of the sleeve 8, a melt feed hole 8A is provided as a molten metal shot hole and communicates with a molten metal holding chamber 8B inside of the sleeve 8.

Reference numeral 10 is a sprue bushing which is arranged fastened to the stationary die 3. The right end of the sprue bushing 10 abuts against the left end of the sleeve 8. Alternatively, the left end of the sprue bushing 10 is on the left end face of the stationary die 3, a powder control valve guide hole G1 is formed passing through the sprue bushing 10 from the left end toward the right end, and the right end of this powder control valve guide hole G1 is provided approaching the inside of the sleeve 8. Furthermore, near the left end of the sprue bushing 10, a discharge hole 10A which opens to the inside of the powder control valve guide hole G1 is formed. This discharge hole 10A is linked with the melt passage 11 which is connected to the cavity C.

At the movable die 7, a guide bushing 12 is arranged fastened from its right end to its left end. This guide bushing 12 is formed with a powder control valve guide hole G2 of the same diameter as and coaxial with the powder control valve guide hole G1 of the sprue bushing 10. Further, the movable die 7 and the stationary die 3 are fastened and the facing surfaces made to abut. In that state, the right end of the guide bushing 12 and the left end of the sprue bushing 10 abut and the powder control valve guide hole G2 of the guide bushing 12 and the powder control valve guide hole G1 of the sprue bushing 10 form a single powder control valve guide hole G. In the above way, the sleeve 8, sprue bushing 10, and guide bushing 12 form a single sleeve member which extends passing through the movable die set 4, 7 and stationary die set 1, 3.

Further, inside the powder control valve guide hole G which is formed inside the sprue bushing 10 and guide bushing 12, a powder control valve 30 is movably arranged. The powder control valve 30 is formed at its right end with a cylindrical valve part 31 which closely contacts the powder control valve guide hole G and is formed with an operating rod part 32 from the cylindrical valve part 31 toward the left.

Further, inside of the powder control valve 30, a powder release agent passage (hereinafter referred to as a "powder passage") 33 is formed. Both of an inlet 33A and an outlet 33B of the powder passage 33 are formed at the outer surface of the powder control valve 30. The powder passage inlet 33A is formed at the outer surface of the operating rod part 32, while the powder passage outlet 33B is formed at the outer circumferential surface of the cylindrical valve part 31. The powder passage 33 is comprised of an inlet passage 330 which extends from the inlet 33A toward the axial center of the powder control valve 30 in the diametrical direction, a main passage 33C which perpendicularly intersects the inlet passage 33D and extends in the axial direction of the powder control valve 30, and an outlet passage 33E which perpendicularly intersects the main passage 33C and extends toward the outer circumferential surface of the cylindrical valve part 31.

The powder passage outlet 33B is connected through a flow path 34 to a powder storage source T, while the powder passage inlet 33A faces the discharge hole 10A to form a passage connecting to the cavity C in the step of coating the powder release agent.

Reference numeral 18 is a drive device, arranged facing the powder control valve 30, which is comprised of an air cylinder, hydraulic cylinder, spring, etc. and which controls the position of the powder control valve 30 in the lateral direction. The right end of the output rod 18A of the drive device 18 abuts against the left end of the operating rod part 32 of the powder control valve 30.

Reference numeral 22 is a powder or air suction passage with one end which opens inside of the cavity C and with another end which is connected to a pressure reducing device constituted by a vacuum pump P. The suction passage is controlled to open and close by a shutoff valve 24 which is actuated by the drive device 23.

Further, in the state where the powder control valve 30 has moved the most rightward inside of the powder control valve guide hole G, the cylindrical valve part 31 of the powder control valve 30 disconnects the sleeve 8 and the discharge hole 10A connected with the melt passage 11 and connects the discharge hole 10A and the powder release agent passage (below, referred to as the "powder passage") 33. Alternatively, in the state where the powder control valve 30 has moved the most leftward inside of the powder control valve guide hole G, the cylindrical valve part 31 connects the sleeve 8 and the discharge hole 10A and disconnects the discharge hole 10A and the powder passage 33.

Next, the steps for producing a die-casting product using the vacuum die-casting machine 100 of the present invention will be explained. One cycle of casting in vacuum die-casting can be roughly divided into a release agent coating step, an evacuation step, a filling step, an injection step, a solidification step, and a product ejection step. The release agent coating step is a step of coating a release agent on the mold surfaces inside the cavity, the evacuation step is a step of evacuating the inside of the cavity and holding it in a vacuum state, the filling step is a step of filling a melt into a sleeve from a filling hole, the injection step is a step of injecting the melt filled inside of the sleeve through a melt passage to the inside of the cavity by making a plunger move, the solidification step is a step of causing the melt which was injected into the cavity to solidify inside of the cavity, and the product ejection step is a step of taking out the product which has solidified inside of the cavity from the cavity.

Here, the different steps will be explained in detail. First, the step of coating the release agent will be explained. The movable die 7 is made to abut against the stationary die 3 to clamp the dies and the fixed core 1 and movable core 4 are made to abut to form a cavity C. At this time, the plunger 9 is at the right end of the sleeve 8 and the melt feed hole 8A is opened. Further, the drive device 18 extends the output rod 18A rightward and makes the operating rod part 32 of the powder control valve 30 move rightward by pushing to thereby make the powder control valve 30 advance to the right in FIG. 1 and hold it there. The position of this powder control valve 30 is referred to as the "first position". In this state, the right end 31A of the cylindrical valve part 31 of the powder control valve 30 is arranged approaching the inside of the sleeve 8, the cylindrical valve part 31 is arranged in close contact with the powder control valve guide hole G1 of the sprue bushing 10 approaching the sleeve 8, and thereby the sleeve 8 and the discharge hole 10A which is communicated with the melt passage 11 are disconnected. On the other hand, the powder passage 33 which is formed inside of the powder control valve 30 and the discharge hole 10A which communicates with the melt passage 11 are communicated through the powder passage outlet 33B.

Alternatively, the drive device 23 is driven to make the shutoff valve 24 move leftward in the figure to open the suction passage 22 and communicate the cavity C and the vacuum pump P through the suction passage 22.

Further, by driving the vacuum pump P in this state, the air inside the cavity C is evacuated through the suction passage 22 to reduce the pressure inside of the cavity C. Further, the pressure which falls inside of this cavity C acts through the melt passage 11, discharge hole 10A, powder passage outlet 33B, powder passage 33, powder passage inlet 33A, and flow path 34 on the powder storage source T. Due to this, inside of the powder storage source T, a powder release agent comprised of ultrafine particle-like solids in a floating fluid state such as a wax, talc, or graphite is sucked out through the powder passage 33 to the inside of the discharge hole 10A. Furthermore, it is sucked out from the discharge hole 10A through the melt passage 11 to the inside of the cavity C whereby the inside of the cavity C is filled by the powder release agent. Further, the powder release agent which is inside the cavity C strikes the mold surfaces 1A, 4A which form the cavity C to thereby be coated on the mold surfaces. On the other hand, the powder release agent which remains inside of the cavity C is sucked in through the suction passage 22 to the vacuum pump P side and exhausted.

Further, the time during which the vacuum pump P is used to reduce the pressure inside of the cavity C, in other words, the time during which the inside of the cavity C is fed with a powder release agent and the mold surfaces are coated with the powder release agent, is suitably set to the optimal time according to the mold surface structure of the cavity C, the volume of the cavity C, etc. After the elapse of this set time, next, the powder passage outlet 33B is closed. When this powder passage outlet 33B is closed, the feed of powder release agent from the powder storage source T through the powder passage 33 to the inside of the cavity C is stopped.

The evacuation step will be explained. A suction passage 22 is held in the open state by a shutoff valve 24. A powder control valve 30 is moved slightly left from the right position at the time of the coating step so as to close the powder passage outlet 33B whereby the powder passage 33 is disconnected from the cavity C. This position of the powder control valve 30 is referred to as the "second position". If this powder passage outlet 33B is closed, the feed of powder release agent from the powder storage source T through the powder passage 33 to the inside of the cavity C is stopped. Further, the vacuum pump P continues to suck out the air inside of the cavity C through the suction passage 22. Therefore, the cavity C shifts to a vacuum state. The evacuated state inside of the cavity C, as explained next, is continued until the shutoff valve 24 closes the suction passage 22. Due to the evacuation step, it is possible to make the coated thickness of the powder release agent uniform.

The filling step will be explained next. In the filling step, the powder control valve 30 and plunger 9 and the shutoff valve 24 are in the same state as the release agent coating step or evacuation step. That is, if looking at the powder control valve 30, the powder control valve 30 is at the first position or second position, the cylindrical valve part 31 is arranged in close contact with the powder control valve guide hole G1 of the sprue bushing 10, and the sleeve 8 and discharge hole 10A are disconnected. Alternatively, if looking at the plunger 9, the plunger 9 is at the right end of the sleeve 8 and opens the melt feed hole 8A. Further, the desired amount of metal melt is filled from the filling hole 8A to the inside of the sleeve 8. The above is the filling step of the metal melt into the sleeve 8, but this filling step can be performed simultaneously with the release agent coating step or evacuation step. This is because the powder control valve 30 is at the first or second position, and the cylindrical valve part 14 disconnects the sleeve 8 and the discharge hole 10A.

Next, the injection step will be explained. The plunger 9 at the right end of the sleeve 8 is moved left at a low speed while closing the melt feed hole 8A and gradually reduces the volume inside of the sleeve 8. Further, the plunger 9 shifts from low speed movement to high speed movement. At this time, the drive device 23 causes the shutoff valve 24 to move to the right, close the suction passage 22, and disconnect the cavity C and the vacuum pump P. Due to the shift of the plunger 9 from low speed movement to high speed movement, the pressure of the melt inside of the sleeve 8 rises. This melt pressure is received by the right end 31A of the powder control valve 30 whereby the powder control valve 30 moves to the left against the right direction pushing force of the drive device 18. This position of the powder control valve 30 is referred to as the "third position". Due to the left direction movement of this powder control valve 30, the cylindrical valve part 14 connects the discharge hole 10A and the sleeve 8. Due to this, the melt which is inside the sleeve 8 and which is raised in pressure is injected all at once through the discharge hole 10A and melt passage 11 toward the inside of the cavity C in the vacuum state. This state is shown in FIG. 2.

The start timing of the leftward movement of this powder control valve 30 is preferably at least after high speed movement of the plunger 9. Alternatively, the drive force which moves the powder control valve 30 left may be provided not by use of the melt pressure, but by detection of the position of the plunger 9 and operation of an electromagnetic device.

Further, after the end of this injection step, along with the elapse of a certain time in the die clamped state, the melt which was injected inside of the cavity C is cooled and solidifies. This is the solidification step.

Next, the product ejection step will be explained. The movable die 7 separates from the stationary die 3 resulting in an opened state. The product which is formed solidified in the cavity C is, for example, moved together with the movable core 4 in a state attached to the mold surface 4A of the cavity C of the movable core 4. Suitably thereafter, it is ejected by not shown ejector pins from the mold surface 4A of the movable core 4 whereby the product is taken out. This is the product ejection step.

As explained above, it becomes possible to provide a reduced size vacuum die-casting machine wherein the amount of powder release agent which is fed to the mold cavity each time is stable and loss of velocity of the air flow for sucking out the powder release agent is difficult.

While the invention has been described with reference to specific embodiments chosen for purpose of illustration, it should be apparent that numerous modifications could be made thereto by those skilled in the art without departing from the basic concept and scope of the invention.

The invention claimed is:

1. A vacuum die-casting machine, comprising:

a movable die and stationary die, one or both of which having a cavity, a powder storage source which stores a powder release agent which is to be coated on a surface of said cavity, a vacuum pump which is communicated with said cavity through a shutoff valve, a sleeve which extends passing through said movable die and stationary die and which has a molten metal shot hole for the inflow of molten metal, a molten metal holding chamber which holds molten metal, and a discharge hole for discharging molten metal or powder release agent to the inside of said cavity, a molten metal injection plunger which slides inside of said sleeve to inject molten metal of said molten metal holding chamber from said discharge hole toward said cavity, and a powder control valve which has a powder release agent passage through which a powder release agent passes and which moves back and forth inside of said sleeve to switch between a state which connects said discharge hole with said molten metal holding chamber and a state which connects said discharge hole with said powder release agent passage, said powder release agent passage of said powder control valve being formed inside of said powder control valve, and an inlet and outlet of said powder release agent passage being formed at an outer surface of said powder control valve, wherein said powder control valve can switch to a state which does not communicate said discharge hole with said molten metal holding chamber and which does not communicate said discharge hole with said powder release agent passage either, and said powder release agent passage includes an elongated hole in said powder control valve which is solid without a hollow space therein except for the elongated hole.

2. A vacuum die-casting machine as set forth in claim 1, wherein said powder control valve is provided with a cylindrical valve part and an operating rod part, said inlet of said powder release agent passage is formed at an outer surface of the operating rod part, and the outlet of said powder release agent passage is formed at an outer circumferential surface of the cylindrical valve part.

* * * * *